US005215014A

United States Patent [19]

Burger et al.

[11] Patent Number: 5,215,014

[45] Date of Patent: Jun. 1, 1993

[54] POSITIONING SYSTEM FOR ROTARY FOLDING JAW CYLINDER ADJUSTMENT ELEMENTS IN A ROTARY PRINTING MACHINE

[75] Inventors: Rainer Burger, Augsburg; Hans Mamberer, Königsbrunn, both of Fed. Rep. of Germany

[73] Assignee: MAN Roland Druckmaschinen AG, Offenbach am Main, Fed. Rep. of Germany

[21] Appl. No.: 835,191

[22] Filed: Feb. 13, 1992

[30] Foreign Application Priority Data

Mar. 27, 1991 [DE] Fed. Rep. of Germany ..... 4110035

[51] Int. Cl.[5] ..... B41F 13/24

[52] U.S. Cl. ..... 101/248; 493/405; 493/424

[58] Field of Search ..... 101/248, 216, 232; 493/321, 356, 360, 397, 405, 417, 424, 427, 428, 434, 435, 442, 443, 448; 270/8, 20.1, 21.1, 46, 32, 47

[56] References Cited

U.S. PATENT DOCUMENTS

| | | | |
|---|---|---|---|
| 3,858,052 | 12/1974 | Luska | 101/248 |
| 4,458,893 | 7/1984 | Ruh | 101/248 |
| 4,484,522 | 11/1984 | Simeth | 101/248 |
| 4,785,733 | 11/1988 | Hartung et al. | 101/248 |
| 4,821,640 | 4/1989 | Hajek et al. | 101/248 |
| 4,896,600 | 1/1990 | Rogge et al. | 101/248 |
| 4,935,683 | 6/1990 | Kobler et al. | 101/148 |
| 5,040,460 | 8/1991 | Stark et al. | 101/232 |
| 5,048,362 | 9/1991 | Becker et al. | 101/248 |

FOREIGN PATENT DOCUMENTS

| | | |
|---|---|---|
| 1561073 | 4/1970 | Fed. Rep. of Germany . |
| 2537920 | 3/1977 | Fed. Rep. of Germany . |
| 3838314 | 5/1990 | Fed. Rep. of Germany . |

*Primary Examiner*—Eugene H. Eickholt
*Attorney, Agent, or Firm*—Frishauf, Holtz, Goodman & Woodward

[57] ABSTRACT

To position two relatively rotatable elements, for example folding jaw control elements of a folding jaw cylinder of a rotary printing machine, with respect to each other, and re-position the elements, a positioning drive (7), for example a motor coupled to a gear, which is coupled for rotary transmission to an axially movable shaft or rod element (10, 10'), movable, for example, under fluid, preferably pneumatic pressure. When projected, the coupling element is engageable with a positioning gear (12) on one of the elements (22) and, upon rotation of the element by the positioning drive, can effect re-adjustment of the angular position of the other element, upon engagement with a positioning gear (11) coupled thereto. The arrangement permits remote positioning and indication of relative position by a feedback transducer (13, 113), such as a potentiometer, which can provide position signals suitable for a display (B).

19 Claims, 5 Drawing Sheets

POSITIONING SYSTEM FOR ROTARY FOLDING JAW CYLINDER ADJUSTMENT ELEMENTS IN A ROTARY PRINTING MACHINE

REFERENCE TO RELATED PUBLICATION

German Patent 25 37 920, Petersen.

Reference to related application, assigned to the assignee of the present application: U.S. Ser. No. 07/822,345, filed Jan. 17, 1992, Roettger et al.

FIELD OF THE INVENTION

The present invention relates to an adjustment system for rotary elements used in a rotary printing machine, and more particularly to adjustment systems used with accessory apparatus, such as folding apparatus, including folding jaw cylinders, folding blade cylinders, cutters, perforation cylinders and the like, in which a specific element is to be positioned with respect to another, so that either the phasing of the respective elements can be controlled, adjusted, or re-adjusted, or other changes made in selected parameters of the elements without disassembling the elements from a rotary printing machine or station. The invention is particularly applicable to an adjustment or positioning system for folding jaw cylinders.

Definition

The terms "positioning", "adjustment", "re-positioning", and "re-adjustment", as used herein, are used interchangeably in accordance with the appropriate context, as far as the apparatus effecting, respectively, positioning or re-positioning, for example, is concerned.

BACKGROUND

Frequently, adjustment work is necessary to match rotary elements of rotary printing machines, for example folding blade cylinders, folding jaw cylinders, collection cylinders and the like, to different production conditions. Usually, such adjustment work is done upon preparing the printing machine for the subsequent printing job. This is done during a pre-setting phase, when the machine is stopped. The adjustment work is frequently done manually by machine operators, directly at the machine, since remote control is possible only with extremely complex apparatus, if at all.

The referenced German Patent 25 37 920, Petersen, assigned to a predecessor company of the present application, describes a system which permits remote control of the folding jaws of a folding jaw cylinder, even when the printing machine is running. While the possibility to adjust or re-adjust a folding jaw cylinder in an operating printing machine is desirable, the result is a rather complex construction of the folding jaw cylinder. This is so not only since it is necessary to transfer adjusting or re-adjusting movement to rotary elements; it is additionally caused by the requirement that the positioning and re-positioning forces must be transferred to the folding jaw cylinder without distortion, for example due to torsion effects of transferring elements or the like. The adjustment arrangement, as known, was found to be subject to malfunction if paper dust or the like, which occurs during printing operation, happens to deposit on adjustment elements, and particularly on associated gearing or the like.

THE INVENTION

It is an object to provide an adjustment or positioning apparatus for rotary elements, which can be remotely controlled or, selectively, manually controlled, and which is simple in construction and reliable in operation.

Briefly, a positioning system for use in combination with a rotary printing machine for a rotary structure in the printing machine includes a stationary positioning drive element, such as a motor or the like, coupled to a gear for example. An arrangement is provided to selectively interrupt or establish a coupling connection between the positioning drive and at least one of two relatively angularly adjustable positioning elements of the rotary structure.

The selective connection arrangement can include a shaft which is both rotatable, to transmit positioning force from the positioning drive, and longitudinally movable, for example under the influence of a fluid pressure piston, to selectively establish a connection or sever the connection of the positioning drive.

Various features of the invention, together with the operation of the system and apparatus will be described in connection with the following drawings.

DRAWINGS

DETAILED DESCRIPTION

Figure 1:
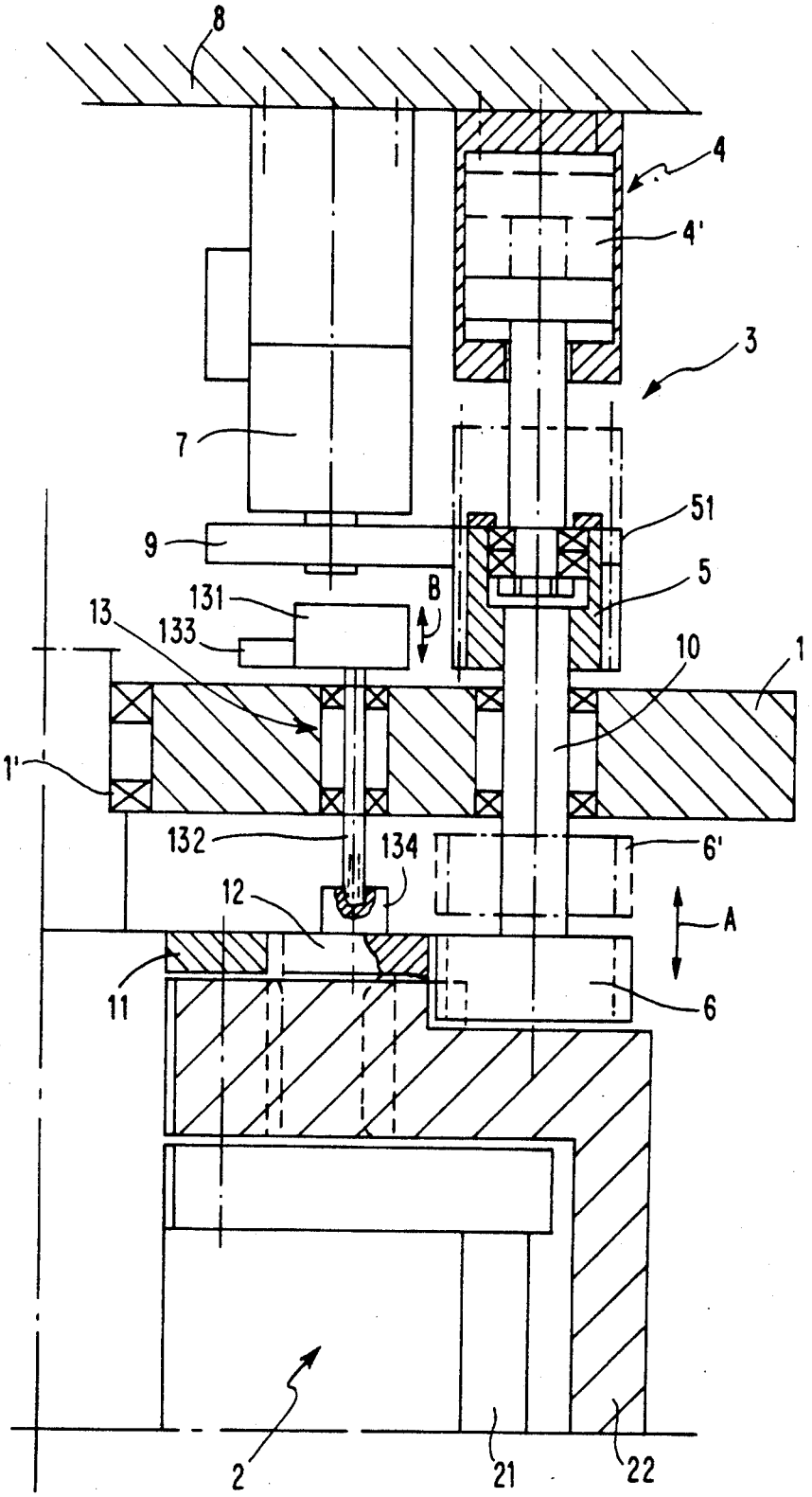
FIG. 1 is a highly schematic, part-sectional view of the first embodiment of the adjustment or positioning system.
Figure 2:
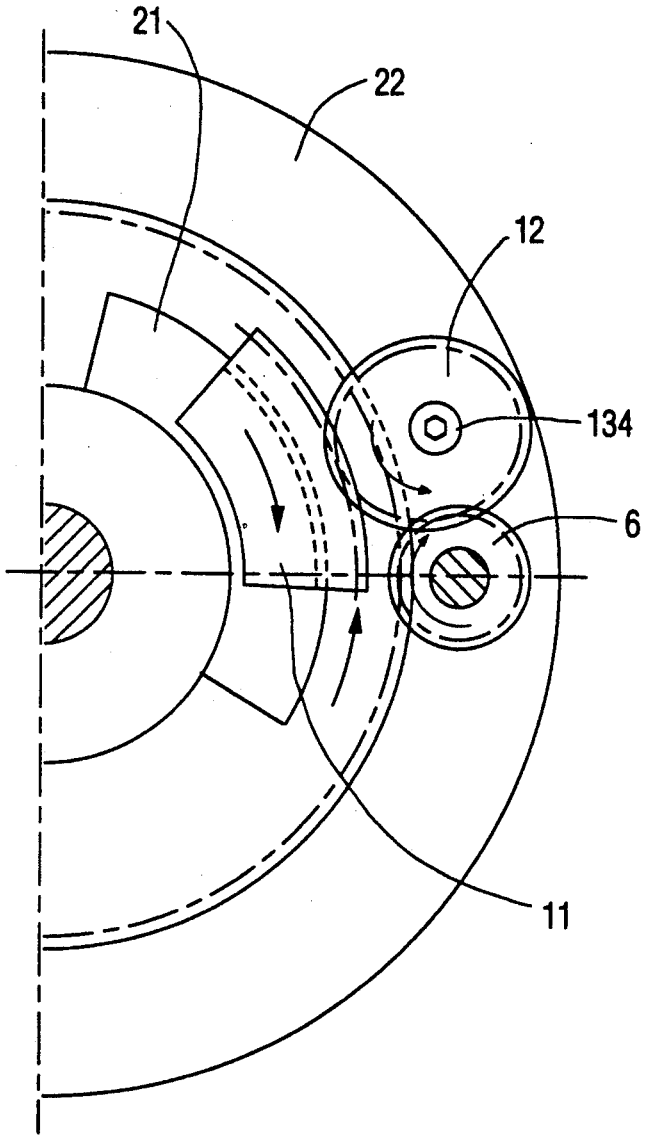
FIG. 2 is a schematic end view of the system, omitting any features not necessary for an understanding of the invention.

Referring first to FIGS. 1 and 2:

FIG. 1 illustrates, in highly simplified, schematic form, an arrangement for remote adjustment of a folding jaw cylinder of a rotary printing machine, in which an adjustment element, for example a segment of the surface element, is to be rotated with respect to another element of the folding jaw cylinder, for example a base body thereof.

The printing machine, as is usual, has a side wall 1, in which a folding jaw cylinder 2 and an adjustment system 3 therefor are retained, the cylinder 2 being rotatably held in the side wall 1 in bearings 1'. Only one half of the cylinder and only one adjustment system are shown for simplicity of representation in the drawing.

In accordance with a feature of the invention, the adjustment system 3 includes a pneumatic cylinder-piston unit 4, a drive coupling 5, a connection coupling 6, and a positioning drive 7. The pneumatic cylinder-piston system 4, having a dual-operating piston 4', and the positioning drive 7 are secured to a support bracket 8 which is fixed in space, for example by being attached in a suitable manner to the side wall 1. The drive coupling 5 is so constructed that it can accept a rotary torque generated by the positioning drive 7 and, further, can transfer axial force derived from the pneumatic piston 4'. The rotary force is transmitted to the drive coupling 5 by an external gearing 51 in engagement with the gear 9 driven by the positioning drive 7. The combined rotary-axial positioning force is transferred by a positioning rod or bolt element 10 to the coupling 6. Coupling element 6, for example, is a gear, secured to the bolt or rod 10 for rotation therewith.

The rotary structure of the printing machine has two relatively movable elements. In the embodiment, the structure 2, formed as a folding jaw cylinder, has a non-adjustable cylinder part or cylinder portion 22 and an adjustable cylinder portion or cylinder half 21, adjustable with respect to the cylinder half or portion 22. The adjustable portion 21, at an end region, is formed or coupled to a gear or a gear segment 11 (FIG. 2) which is in geared engagement with a gear 12. Gear 12 is rotatably secured to the non-adjustable cylinder portion 22. Gear 12 is suitably retained on the portion 22, for example by a stub shaft, not specifically shown. The folding jaw cylinder 2, additionally, is coupled to a position indicator system 13, which is so constructed and arranged that any positioning or adjustment movement of the positionable or adjustable cylinder portion 21 can be transduced by way of a signal, typically an electrical signal, for display on an associated display D (FIG. 4A),so that the adjustment can be visually checked.

The adjustment system 3 is so constructed that, with respect to the gear 12, the coupling element 6 can be engaged with the gear 12—full-line position in FIG. 1—or disengaged therefrom—retracted and chain-dotted position 6' in FIG. 1.

Operation, positioning and re-positioning

The folding jaw cylinder 2 is adjusted in this manner:

Let it be assumed that the adjustment system 3 is in a base position, that is, the gearing 6 is in the withdrawn, chain-dotted position 6', and is out of engagement with respect to gear 12. The folding jaw cylinder 2, thus, can rotate freely.

To start the positioning, the folding jaw cylinder 2 is stopped in a specific position, namely such that the gear 6 can be extended or projected from the chain-dotted position 6' for engagement with the gear 12. When the folding jaw cylinder has reached such a position, it is locked, in well known manner, by any suitable cylinder locking arrangement, well known in the printing machinery field.

The actual adjustment can now begin. By pneumatically charging the cylinder-piston arrangement 4, the piston 4' is pushed downwardly—with respect to FIG. 1—so that gear 6 and gear 12 are engaged. At the same time, a previously established locked position between the elements 21 and 22 of the folding jaw cylinder 2 is released in order to permit re-positioning of the elements 21 and 22 with respect to each other.

The positioning drive 7 is then rotated in a suitable direction of rotation until the desired adjustment of the folding jaw cylinder 2, by re-positioning the movable element 21, is obtained. During this re-positioning, the position transducer 13 provides a signal which is transmitted to a control unit 14 (FIG. 4A ), in which the instantaneous position, as represented by an electrical signal, is compared with a predetermined command signal applied to terminal 141', when switch 141 is closed. When the actual positioning value signal and the command signal value are equal, the positioning drive 7 is disconnected, and the positionable cylinder portion 21 is locked with respect to the non-positionable portion 22. The gear 6 can then be withdrawn, see double arrow A, and the cylinder 2 is released from locked position so it, again, can rotate freely.

In its simplest form, the control unit 14 can be so arranged that activation of the coupling element 6, stopping of the cylinder 2, locking of the cylinder 2, release of cylinder portion 21 from cylinder portion 22, and energization of the positioning drive 7, both with respect to duration of rotation as well as direction of rotation, can be controlled by suitable control switches. The operator, for example, can read the actual adjustment position of the width of folding jaws of the folding jaw cylinder on the display element D. If re-positioning is needed, for example if printed products of thicker paper or a larger or smaller number of pages to be folded together are to be accepted by the folding jaws, the operator then starts the positioning or re-positioning sequence and operates the switch 141, after the gear 6 is engaged with the gear 12, until the required width of the folding jaw is indicated on the display D. When this equality has been reached—which can also be determined electrically—the portions 21, 22 of the folding jaw cylinder can be locked in position and the overall cylinder then released for rotation.

Figure 4A:
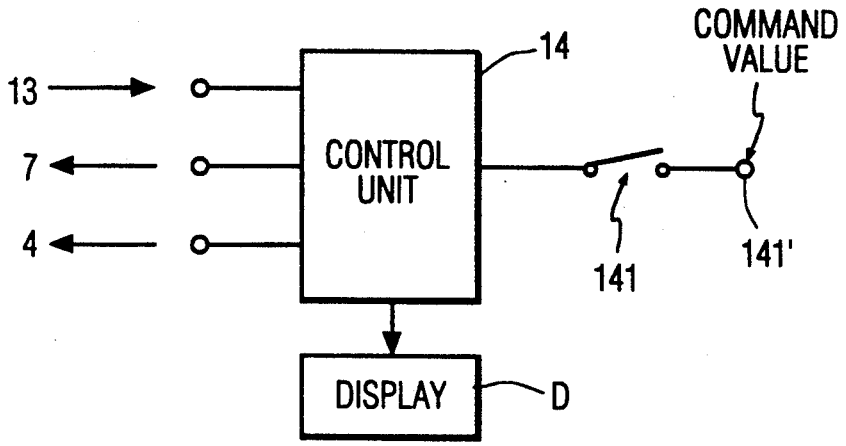
FIG. 4A is a schematic diagram of a control system for remote control of adjustment in accordance with the present invention.
Figure 4B:
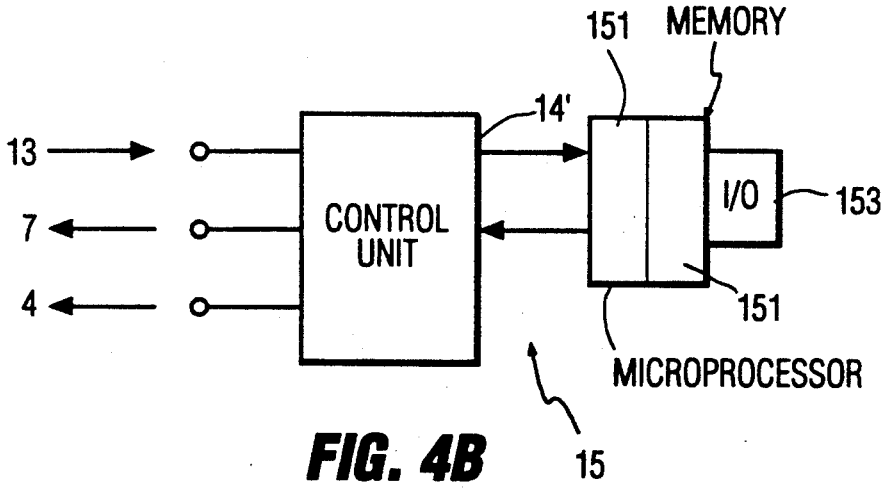
FIG. 4B illustrates another embodiment of the control system.

In accordance with a preferred feature of the invention, the positioning drive 7, the pneumatic piston-cylinder arrangement 4, and stopping or locking arrangements can all be controlled by the control system 15 (FIG. 4B), constructed in form of a microprocessor. The system 14 of FIG. 4A is expanded by a microprocessor element 152, an input/output unit 153, and a memory unit 151. If the embodiment of FIG. 4B is selected, the operator of the printing machine need only select and enter for recall from the memory the width of the folding jaws to be set for the next folding job to be carried out, and, at a suitable time, commands the positioning sequence to be controlled by the microprocessor. The microprocessor then, in accordance with a well-known sequential control, controls the individual steps of the positioning sequence, explained above, by controlling unit 14'

FIG. 2, in a highly schematic and simplified showing, illustrates a side view of the folding jaw cylinder 2, looked at from the positioning side. The gear 12, gear 6 as well as the gear 11, in segment form, are shown.

Figure 3:
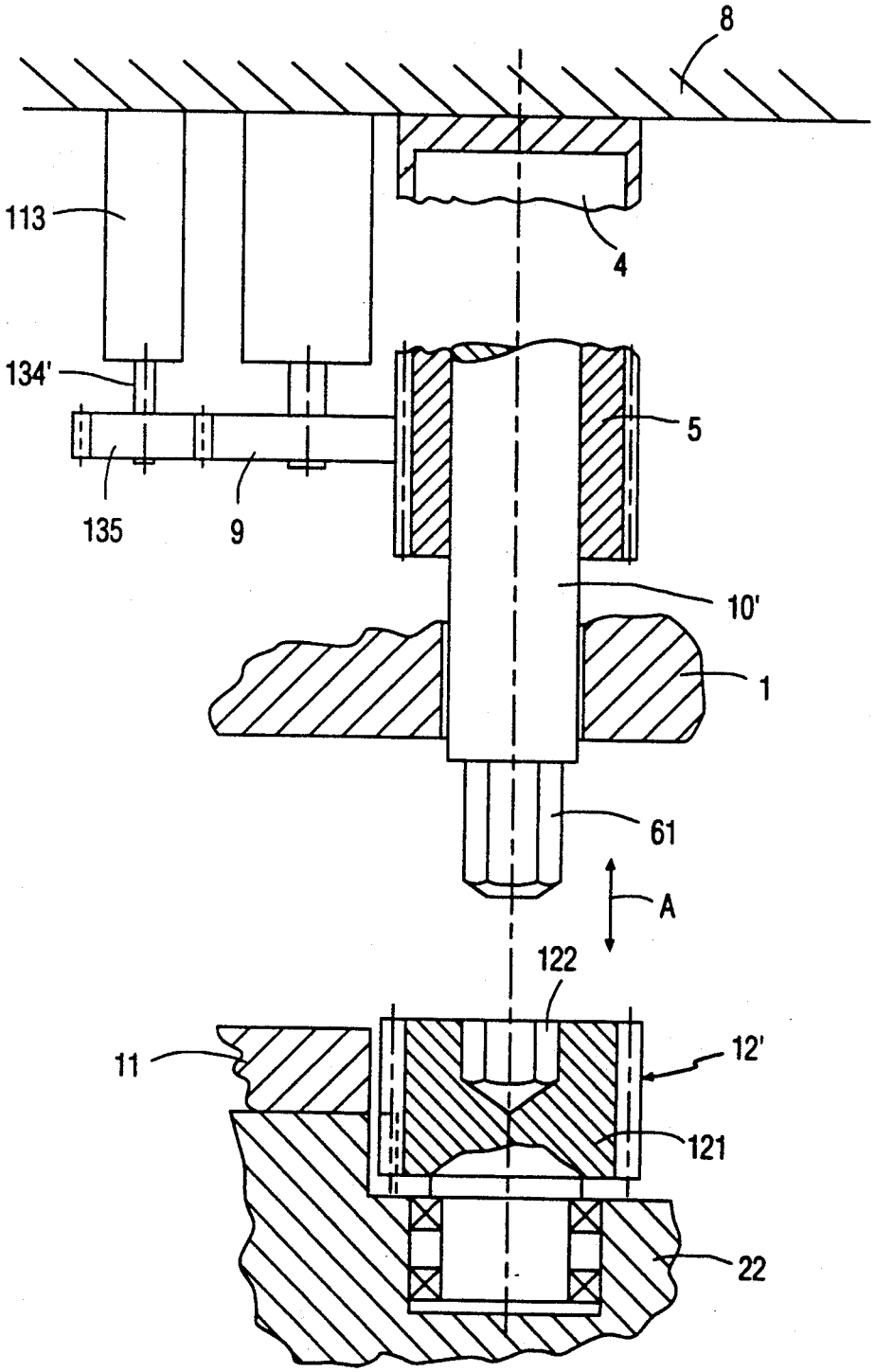
FIG. 3 is a view similar to FIG. 1 of another embodiment of the present invention.

Embodiment of FIG. 3

Only so much of the system necessary for an understanding of the difference between the arrangement of FIG. 1 and FIG. 3 is shown as is necessary. For elements not specifically shown in FIG. 3, reference is made to FIG. 1.

The retractable, projectable element 10' terminates in a hexagonal end portion 61. To engage the folding blade cylinder 2, the gear 12' is formed with a central hexagonal blind bore 122, matched to receive the hexagonal projection 61 extending from bolt 10'. Upon forward movement of the bolt 10', end portion 61 can engage in the recess or hole 122. Since the connection of the coupling element 61 with the gear 12' is an axial connection—in contrast to the tangential connection between the gear 6 and the gear 12 in the embodiment or FIG. 1—adjustment movement is directly transferred to the gear 12'; the adjustable arrangement 3, thus, is so placed with respect to the gear 12' that the coupling element 61 is in axial alignment with the axis of rotation of the gear 12'. Gear 12' is suitably retained and rotatable in a bearing on the jaw cylinder part 22, shown only schematically.

Operation—FIG. 3

The adjustment sequence is similar to that described in connection with FIG. 1. The control circuit 14, 14' likewise can be used, selectively, as before. The engagement or disengagement movement of the coupling element 6, or 61, respectively, and control of the position transducer 13 and the signal derived therefrom are identical. The only change which needs to be made is the direction of rotation of the positioning drive 7 with respect to the desired rotation of the gear 11, since rotary movement of the shaft 10' with respect to the gear 12 is axial, and hence the element 10' and the gear 12 rotate in the same sense of direction, whereas in the embodiment of FIG. 1, the transmission of torque was tangential, so that rotary transmission from the bolt or rod 10 to the gear 12 was in opposite sense of rotation.

The position transducer system 13 (FIG. 1) is preferably formed as a potentiometer located on the folding blade cylinder 2, so that any positioning movement of the folding blade cylinder 2, which can be commanded not only from the drive 7 but, possibly, also done by hand, will be sensed by the transducer system 13. For simplicity, and in order to avoid any complex adjustment, electrical coupling between the transducer 13 and the control unit 14 or 14', respectively, is either carried out via the axis of rotation of the folding blade cylinder 2 or the adjustment system 13 can be engaged at the same time as the positioning system 3 is engaged.

In the embodiment illustrated in FIG. 1, the transducer system 13 has an evaluation circuit which is located at the side of the side wall 1 remote from the folding blade cylinder 2. A translating positioning piston unit 131 can move a positioning shaft 132 in the direction of the double arrow B; in its simplest form, the system 131 uses an air piston cylinder arrangement similar to the arrangement 4. The element 132 corresponds, except for size, to the element 10, in which the longitudinal element 32, at least at its end, is formed with an hexagonal end portion, similar to the end portion 61 (FIG. 3). A position-electrical transducer 133, for example a simple potentiometer, is coupled to receive rotary movement from the shaft 132.

The gear 12 is securely coupled to a projection 134 at the side facing the positioning adjustment system. The projection 134 can be an extending element formed with a hexagonal hole to receive the hexagonal end portion of the bolt 132, to be coupled therewith upon projection downwardly, in FIG. 1, of the bolt 132. In operation, that is, when the bolt 132 is in engagement with the hexagonal end portion of the element 134, the transducer potentiometer or similar element 133 is operatively coupled via the rod element 132 with the gear 12. Upon rotation of the gear 12, the element 134 will rotate and the transducer 133 will provide an electrical signal which, as well known, can be used either to control the display D (FIG. 4) or automatically control the position of the folding jaw element 21, as described above, by use of the automatic control unit 14'. The element 134, as shown, is located at the axis of rotation of the gear 12.

Various changes and modifications may be made; for example, the rod element 132 of the position transducer system 12 can be coupled for axial movement to the rod 10, for conjoint axial movement therewith. Axial shift of the two rods 10, 132 then necessarily will be synchronous. Upon manual operation, however, the synchronized coupling between the rod element 10 and the rod element 132 should be severable in such a manner that only the rod element 132 remains engaged, so that if the folding jaw width is re-adjusted by hand, for example by a suitably shaped tool, or key, a display can be obtained indicating the exact width of the jaws.

Other systems for transmitting information regarding the adjustment width of the jaws, or other adjustments, can be done in different manner, for example by a contactless transmission. Inductive or capacitative rotary position transducers can be used. Alternatively, the free end of the rod elements 10 or 132, respectively, and the associated counter element 121 or 134, respectively, can be so constructed that connection in engaged position is obtained by suitable friction surfaces formed on the respectively facing elements, that is, the axial portions of gears 12, or 12', respectively. Blocking of the respectively adjustable rotary element can be carried out simultaneously with engagement of the rod-like elements 10, 132, respectively, and unlocking of the rotary elements is carried out simultaneously with the decoupling of the rod-like bodies 10, 132. Locking and unlocking of the rotary elements with respect to each other, or with respect to a reference, can easily be interlocked, for example by a monitoring electrically supervised interlock circuit, which can be included in the control unit 14, 14', respectively, as well known.

In the embodiment of FIG. 3, the positioning transducer such as a potentiometer 113 is secured, together with the positioning drive 7 and the piston-cylinder unit 4 on the support element 8. The positioning transducer 13 is connected to a shaft 134' which, in turn, is coupled to a gear 135 which is engaged with the gear 9 of the positioning drive. After engagement of the coupling element 61, the instantaneous position of the gear 12' is thus transferred as an electrical signal to the transducer 113.

Figure 5:
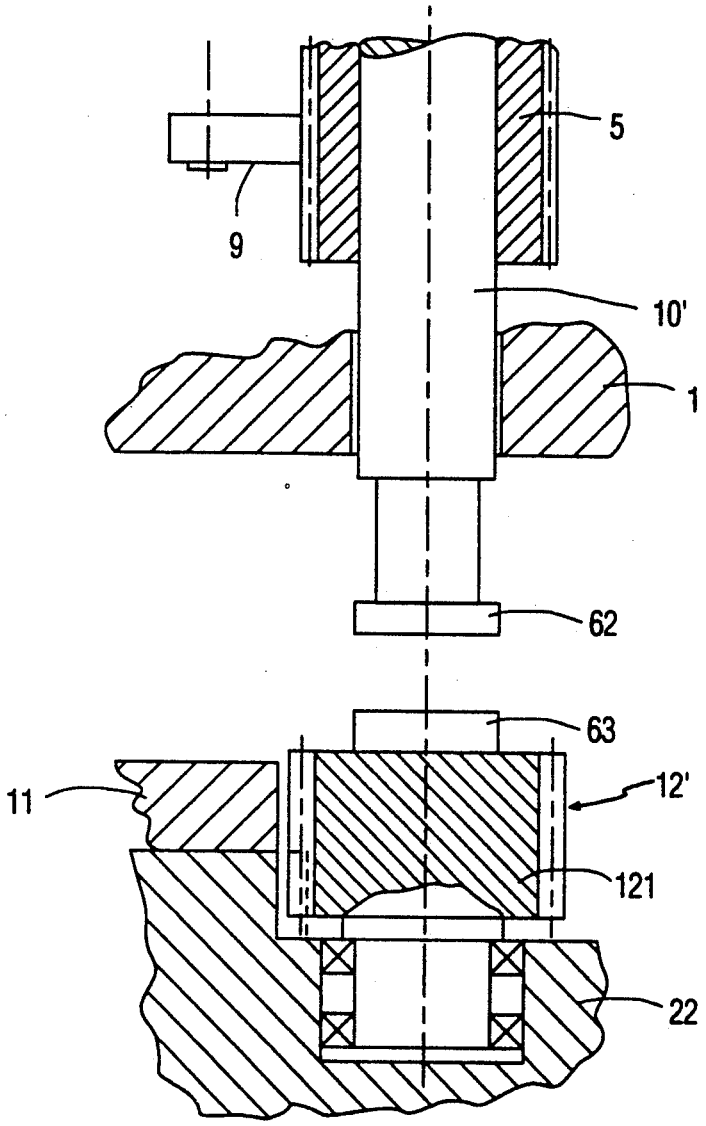
FIG. 5 is a highly schematic fragmentary view illustrating yet another embodiment, based on the arrangement of the system of FIG. 3.

FIG. 3 illustrates a positive drive connection between the element 10' and the gear 12'. FIG. 5 shows a face-to-face friction clutch connection 62, 63; rather than using a friction clutch, a claw clutch could also be used.

The control circuits 14, 14' (FIGS. 4A, 4B) are shown with the respective connections to supply or deliver the corresponding positioning signals. The reference numerals on elements 14, 14' correspond to the signals coupled to the respective elements with the same reference numerals in FIGS. 1, 3 and 5. Drive 7 can include an electric motor.

The positioning transducer 13, 113, respectively, may of course be combined, as desired, with any one of the embodiments shown in FIGS. 1, 3 and 5.

The invention is not limited to the adjustment of the width of jaws of folding jaw cylinders, or other adjustments of cylinders in a printed product folding system; rather, various possibilities for use of the present invention in rotary printing machines suggest themselves, although the system is primarily applicable to folding apparatus units, in which position or phase position, respectively, is to be changed. The invention is equally applicable to the positioning or re-positioning of folding blades, cutter blades, perforating elements and perforating cylinders and various other positionable elements on rotary cylinders used in rotary printing machines.

Various changes and modifications may be made, and any features described herein may be used with any others, within the scope of the present invention.

We claim:

1. In combination with a rotary printing machine, a positioning system for a folding jaw cylinder of the printing machine and forming a rotary structure (2), which structure is formed of two relatively angularly positionable elements (21, 22), wherein one (22) of said elements is a non-adjustable cylinder portion and the other (21) of said elements is an adjustable cylinder portion relatively angularly adjustable with respect to the non-adjustable cylinder portion (22), the relative position of said elements permitting folding of printed subject matter of respectively different thicknesses, said positioning system comprising, in accordance with the invention, a stationary positioning drive means (7) secured to a frame of the printing machine;

a positioning transducer (13, 113) for delivering a signal representative of the relative angular position of one (21) of said elements with respect to the other (22);

and a control system (14, 15) receiving position signals from said positioning transducer (13, 113) indicative of the relative angular position of said positionable elements and having means (141, 153) for controlling the positioning drive means (7) in accordance with position adjustment commands supplied thereto by a command means (141'); and means (3, 4, 6; 61, 122; 62, 63) for selectively interrupting or establishing positioning drive connection between said positioning drive means (7) and at least one (21) of said elements of said rotary structure (2) under control of said control system.

2. The system of claim 1, wherein said selective drive connection means comprises a shaft element (10, 10') which is both rotatable and axially movable; and means (9, 51) for coupling rotary movement from said positioning drive means (7) to said shaft element.

3. The system of claim 1, wherein said selective drive connection means comprises a shaft element (10, 10') which is both rotatable and axially movable; and selectively axially operating means (4) coupling axial movement to said shaft element.

4. The system of claim 1, wherein said selective drive connection means comprises a shaft element (10, 10') which is both rotatable and axially movable; and selectively axially operating means (4) coupling axial movement to said shaft element.

5. The system of claim 1, wherein said coupling or uncoupling means are synchronized and operate together with said means (3, 4, 6; 61, 122; 62, 63) for selectively interrupting or establishing positioning drive connection between said positioning drive means (7) and at least one of said elements.

6. The system of claim 1, wherein said means for selectively interrupting or establishing positioning drive connection comprises a fluid piston (4);

a coupling rod (6, 61);

a drive coupling (5) rotatably coupled to said coupling rod (6, 61) for transferring rotary movement from said coupling drive means (7) to said positioning rod, said coupling rod being coupled to said fluid piston (4) to transfer axial force applied on said coupling rod, as well as rotary force applied by said positioning drive means thereto.

7. The system of claim 6, including a rod drive means comprising an external gearing (51) connected to said coupling rod (6, 61); and wherein said positioning drive means (7) includes a positioning drive gear (9) in gearing engagement with said external gearing (51).

8. The system of claim 4, further including a positioning coupling element connected to said shaft element.

9. The system of claim 8, wherein said coupling element is coupled to said shaft element in rotation-transmitting relationship.

10. The system of claim 8, wherein said positioning coupling element comprises a gear element (6).

11. The system of claim 8, wherein said positioning coupling element comprises a hexagonal stub or key.

12. The system of claim 8, wherein said positioning coupling element comprises a friction coupling (62, 63).

13. The system of claim 1, wherein said rotary structure includes a gear (12); and said means for selective interruption or establishing positioning drive connection comprises means selectively engageable with or disengageable from said gear.

14. The system of claim 13, wherein said gear (12) includes an engagement element (134), and selective engagement means (132) selectively engageable with said element or interruptable therefrom, for selectively establishing rotary connection to said element; and a position transducer, fixed on said printing machine, and selectively couplable to said selective connection means.

15. The system of claim 10, wherein said gear (12) is formed with an axially centrally located polygonal depression(122); and wherein said means for selectively interrupting or establishing positioning drive connection includes a projecting element having a polygonal outline matching the polygonal hole, said element being both axially movable for selective engagement and rotatable for establishing a relative angular position of said elements.

16. The system of claim 7, wherein the position transducer converts the position of one of said elements with respect to the other into an electrical signal, said position transducer including a rotary element; and gear means (135) coupled to said gear (9) of the positioning drive means (7).

17. The system of claim 1 wherein the positioning transducer (113) is secure to the frame of the machine; and coupling means (133) are provided, coupling the positioning transducer with respect to that one (21) of the rotary elements, the position of which is to be controlled.

18. The system of claim 1 wherein the control system (14, 15) is connected to said coupling means.

19. The system of claim 1 wherein the positioning transducer (13) includes a piston-cylinder unit (131) and a rotatable and a longitudinally moveable positioning shaft (3), said positioning transducer comprising a rotary-to-electrical signal transducer (33) coupled to the shaft and providing said position signals.

* * * * *